United States Patent [19]

Yaari

[11] Patent Number: 4,480,512

[45] Date of Patent: Nov. 6, 1984

[54] SCREWDRIVER FOR MANUAL OR POWER OPERATION

[76] Inventor: Yigal Y. Yaari, 47 Leamington Rd., Brighton, Mass. 02135

[21] Appl. No.: 558,098

[22] Filed: Dec. 5, 1983

[51] Int. Cl.[3] ..... B25G 1/00

[52] U.S. Cl. ..... 81/436; 145/61 L

[58] Field of Search ..... 81/436; 145/61 L

[56] References Cited

U.S. PATENT DOCUMENTS 4,356,852 11/1982 Smith ..... 145/61 L

*Primary Examiner*—Frederick R. Schmidt
*Assistant Examiner*—J. T. Zatarga
*Attorney, Agent, or Firm*—Wolf, Greenfield & Sacks

[57] ABSTRACT

A screwdriver capable of being operated conventionally by the handle as a manual drive and alternatively being capable of being connected to a power drill so that it may be driven automatically. The screwdriver includes a conventional shank and tip at its end to engage the head of a screw. The handle has a chamber within which a coupling is slidably mounted. When the coupling is in an extended position a substantial part of it is exposed, so that it may be engaged by the chuck of a power drill. When the coupling is drawn into the chamber it does not interfere with conventional use of the screwdriver.

14 Claims, 8 Drawing Figures

SCREWDRIVER FOR MANUAL OR POWER OPERATION

INTRODUCTION

This is an improvement over the invention disclosed in my copending application Ser. No. 356,203 filed Mar. 8, 1982 entitled "Screwdriver".

This invention relates to screwdrivers and more particularly comprises a new and improved screwdriver which is designed to be used either manually as a conventional screwdriver or be connected to a power drill so that it may be driven automatically.

There are a number of arrangements presently available which enable screwdrivers to be power-driven. However, none of the arrangements known to applicant other than those disclosed in my copending application Ser. No. 356,203, supra, provides means whereby an otherwise conventional screwdriver can be conveniently coupled to a power drill so that the screwdriver may be power operated. A screwdriver capable of being used conventionally and which at the election of the user may be connected to a conventional one-quarter inch or three-eights inch drill provides a great convenience particularly to the homeowner or to the hobbyist who is not a professional carpenter or cabinet maker but who undertakes a variety of not-too-difficult chores.

In my copending application Ser. No. 356,203, supra, a number of different embodiments of a screwdriver are shown which are capable of the alternate methods of use. In some embodiments, a coupling device is fixed to the handle and may or may not be used to attach the screwdriver to a power drill. In other embodiments, the coupling is removable from the screwdriver when it is used manually. Both arrangements are very inexpensive to manufacture, but each has certain disadvantages. The removable couplings may easily be lost or misplaced, while the fixed couplings may interfere with the normal manual use of the screwdriver.

The principal object of this invention is to provide a screwdriver which has the appearance of a conventional screwdriver and which may be used manually as a conventional screwdriver but which also may be connected at the election of the user to a power drill so that it may be operated automatically.

Another object of this invention is to provide an otherwise conventional screwdriver which may be conveniently connected to a power drill for automatic use when desired by means of a coupling device permanently connected to the screwdriver but which does not interfere with manual operation of it.

To accomplish these and other objects, the screwdriver of this invention includes an essentially conventional shank and tip provided with a knife edge or Phillips configuration or any other desired configuration so that it may engage the head of a screw, and which also includes a handle that may be conventionally grasped to operate the screwdriver manually. The handle is provided with a chamber in which is mounted a coupling that in one position is essentially confined within the chamber so as not to interfere with manual operation of the screwdriver, and that in a second position extends from the chamber so that it may be engaged by the chuck of a power drill so that the screwdriver may be power driven.

These and other objects and features of this invention will be better understood and appreciated from the following detailed description of several embodiments thereof, selected for purposes of illustration and shown in the accompanying drawing, in which:

BRIEF FIGURE DESCRIPTION

DETAILED DESCRIPTION

Figure 1:
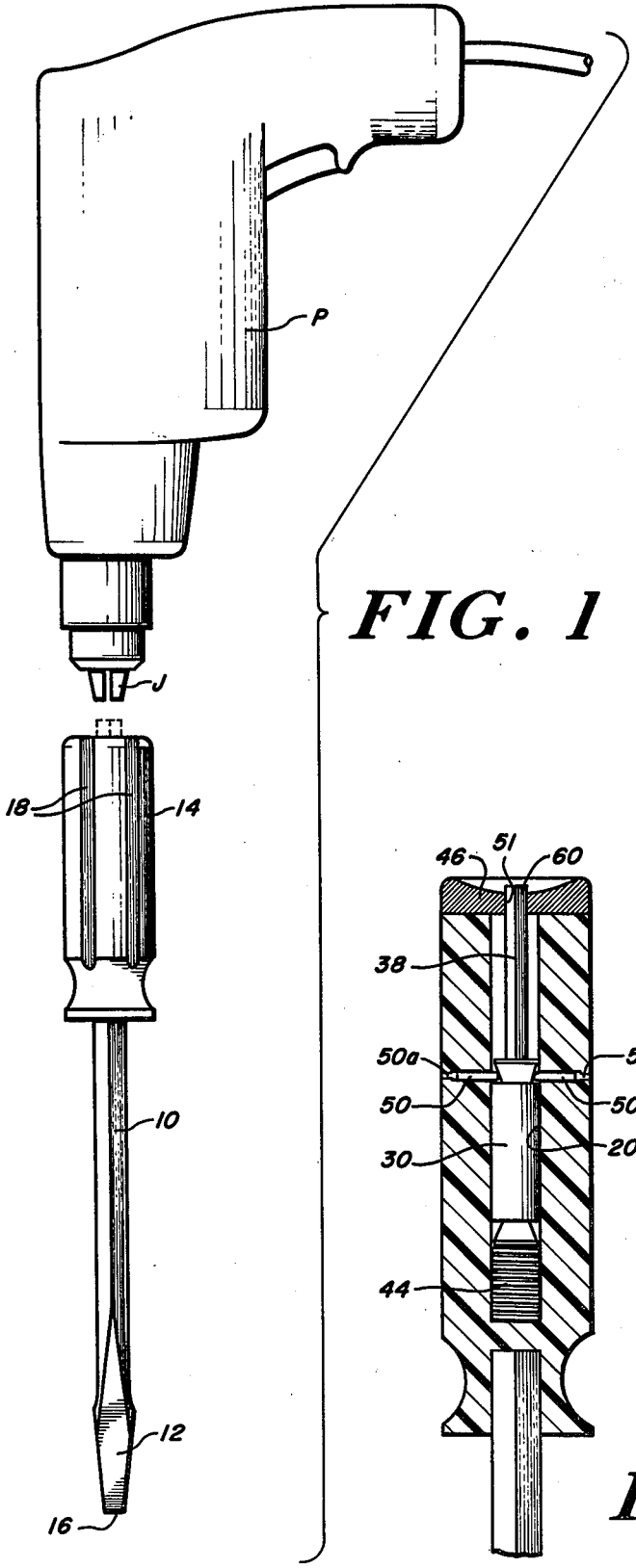
FIG. 1 is an exploded view of a screwdriver with a coupling constructed in accordance with this invention along with a power drill with which the screwdriver may be used.

The screwdriver shown in FIGS. 1 to 6 includes an essentially conventional shank 10 having a tip 12 and handle 14. The tip 12 shown in the drawing has a knife edge 16 designed to engage a conventional single-slotted head of a screw. It will be appreciated, however, that the tip 12 may take other forms such as, for example, that intended to engage the cross slot of a Phillips screw. The shank 10 with its tip 12 typically may be made of hardened steel or other suitable material.

Handle 14 which may be molded plastic or other suitable material is provided with axially extending grooves 18 on its surface to enable the handle to be gripped tightly and conveniently by the user. It will be appreciated that the screwdriver thus far described and shown may be used manually in the conventional manner to drive a screw.

Figure 2:
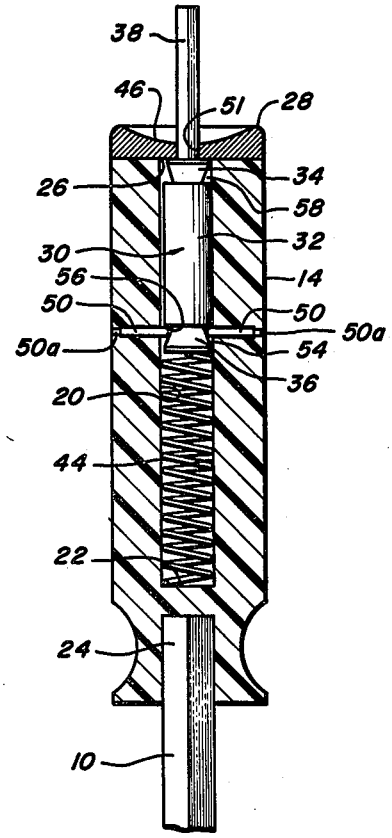
FIG. 2 is a fragmentary cross-sectional view of the screwdriver handle and showing the coupling in its extended position so that it may be engaged by a power drill such as shown in FIG. 1.
Figure 3:
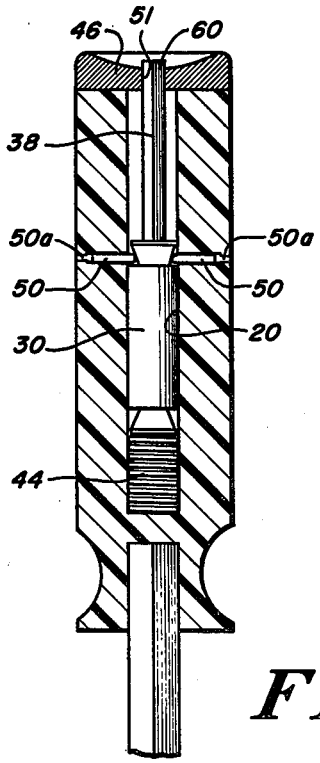
FIG. 3 is a cross-sectional view similar to FIG. 2 and showing the coupling in the retracted position.

The handle 14 is shown in FIGS. 2 and 3 to include a chamber 20 which is circular in cross section and coaxial with the handle. The chamber 20 extends from its bottom 22 adjacent the end 24 of shank 10 to its upper or remote end 26 adjacent the upper end 28 of the handle. Coupling 30 having a main body section 30 which conforms to the cross section of the chamber 20 is movable axially in the chamber and is provided to couple the screwdriver to a power tool such as the power drill P shown in FIG. 1 when the tool is to be automatically operated. Coupling 30 has end sections 34 and 36 which are essentially mirror images of one another and extend from the end walls of the main body section 32. The end sections 34 and 36 are frusto-conical in shape with the smaller ends joining the section 32 and the wider ends disposed remote from that section. End section 34 carries a coupling extension 38 which is designed to be engaged by the chuck jaws J of the power drill P. While in the embodiment illustrated the extension 38 is shown to be hexagonal in cross section (see FIG. 5), obviously the shape may be different, and it is only important that it be sized and shaped to be engaged firmly by the jaws J of the chuck when the tool is intended to be driven by the power drill. A spring 44 disposed in chamber 20 below the coupling biases the coupling to the elevated position shown in FIG. 2, but the coupling may be moved against the bias of spring 44 to the lower position of FIG. 3.

In the lower position of FIG. 3, coupling extension 38 is essentially confined within chamber 20 except for a short section at its upper end which extends out of the chamber 20 into the shallow recess 46 in the end 28 of the handle. In this position, coupling 30 is essentially confined to chamber 20 in the handle so as not to interfere with the manual operation of the screwdriver. When the coupling is to be used to connect the screwdriver to the power drill P, coupling 30 is moved to the elevated position of FIG. 2, wherein the extension 38 is fully exposed so as to be engageable by the chuck jaws J. The coupling is held in either of the two positions of FIGS. 2 and 3 by the radial pins 50 shown in FIGS. 2, 3 and 6.

In FIGS. 1–3 and 6 it will be noted that the upper end 28 of the handle is made as a separate part and is secured to the main portion of the handle by cement or other means. The end 28 is made of a hardened material such as steel and is provided with a central opening 51 which conforms to the cross-section of the coupling extension 38. The opening 51 thereby rotationally locks the handle 14 and coupling 30 together, i.e., rotation of the coupling 30 rotates the screwdriver. The material of the end 28 resists wear on the handle and is strong enough to withstand the forces applied to it by the coupling. And the abrasive action of the ends of the jaws which may engage the end 28 when the screwdriver is connected to the drill P by the coupling.

In FIG. 2, pins 50 are shown to extend into the annular recess 54 defined by the upwardly converging configuration of the frusto-conical end section 36. With the pins in their inner radial position as shown in FIG. 2, they bear against the end wall 56 of central section 32 of the coupling and prevent the coupling from moving downwardly in chamber 20. It will be appreciated that the pins 50 in the position of FIG. 2 will not permit the coupling to be lowered in the chamber and therefore it will remain in the extended position and in position to have the coupling extension 38 engaged by the jaws.

In order to lower the coupling in the chamber 20, the user first pulls the coupling slightly upwardly so as to cause the conical surface of the end section 36 to spread the pins and push them into the radial slots 52 in the handle occupied by them. When the pins, which have no biased position, are moved to the outer radial position as in FIG. 6, the coupling 30 may then be pushed deeper into the chamber 20 against the bias of spring 44 causing the pins 50 to slide along the outer surface of the central section 32 until they are disposed opposite the recess 58 about the narrower end of end section 34 of the coupling. When the pins are opposite the annular slot 58, they may then be pushed radially inwardly so as to occupy the position shown in FIG. 3. In that position, as described above, the coupling extension 38 is confined almost exclusively within the chamber 20 so as not to interfere with use of the screwdriver in the conventional manual manner. When the extension is again to be withdrawn so as to serve as a coupling with the power drill, the operator merely presses the end 60 of the extension 38 so as to cause the conical surface of the end section 34 to spread the pins 50 as in FIG. 6, and thereafter the coupling may be elevated either manually by pulling on the extension 38 or relying upon the action of spring 44.

Figure 6:
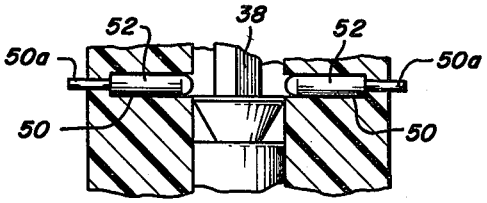
FIG. 6 is an enlarged fragmentary cross-sectional view of the remote end of the handle and coupling and showing the locking pins in their withdrawn position which allows the coupling to be moved in the handle.

As shown in FIG. 6, the pins 50 are provided with short extensions **50*a* that may be grasped by the fingers when the pins are moved radially a short distance from their innermost position. This allows the user to hold the pins in their outermost radial position while the coupling is being moved. When the pins are in their innermost radial position, the extensions 50*a* are confined within the handle so as not to interfere with the comfortable grasping of the handle 14** during manual use.

Figure 7:
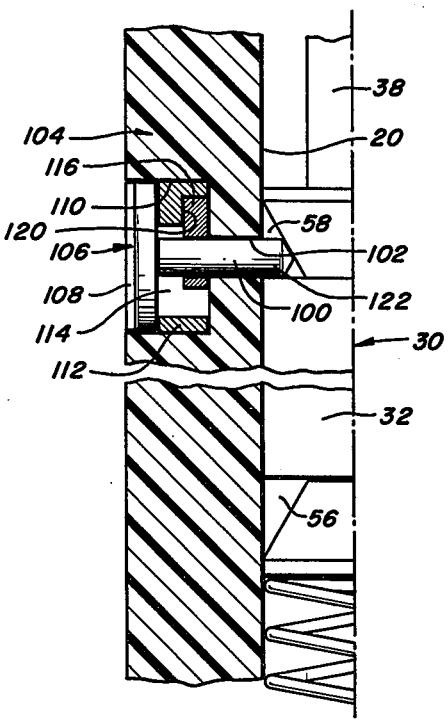
FIG. 7 is an enlarged fragmentary cross-sectional view of another embodiment of this invention.
Figure 8:
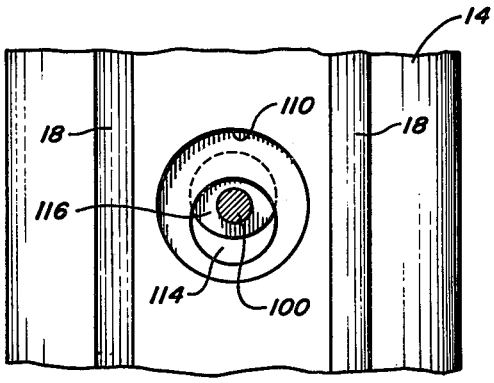
FIG. 8 is a fragmentary side view of half the handle showing alternate positions of one of the pins which holds the coupling in the handle in the embodiment of FIG. 7. The half not shown is the mirror image of the half shown.

In FIGS. 7 and 8, another embodiment of the invention is shown, which differs from that shown in FIGS. 1 to 6 only with respect to the pins which support the coupling 30 in either of the two positions. Like numbers are used to identify like parts in the two embodiments.

The pins 100 (two are provided as in the first embodiment but only one is shown in the half section) movable axially in the radial slots 102 formed in the handle 104 are selectively positionable in the annular recesses 56 and 58 of coupling 30 to hold the coupling in the selected axial position with respect to the bore 20 so as to support the coupling extension 38 in either the extended or withdrawn position. The pins 100 carry disc-shaped handles 106 that have a finger grippable rib 108 on their outer end to faciliate rotation of the pins and pulling them readily outward in slots 102.

Recesses 110 are provided in the handle 104 at the radial outer end of each of the slots 102, and the pin handles 106 are disposed in the slots 110. A ring 112 is permanently positioned in the recess 110 behind the pin handle and defines a two position cam chamber 114 for eccentric 116 carried on the pin 100. Eccentric 116 is shown in FIG. 7 and in full lines in FIG. 8 in the inner lock position as it is captured in the inner end of chamber 110 by shoulder 120 of ring 112. With the eccentric 116 in the position shown, the pin 100 is held in the innermost position wherein it engages either recess 56 or 58 in the coupling to hold it in the set position. In order to move the coupling from the set position, the pin 100 is rotated 180° by means of the rib 108 on the handle end, so as to move the eccentric 116 off shoulder 120 as in the broken line position of FIG. 8. The eccentric is thereby aligned with the cavity 114 in ring 112 so as to enable the pin along with the handle and eccentric to be moved radially outward so as to withdraw the end 122 of pin 100 within the slot 102. Thus, the embodiment of FIGS. 7 and 8 provides a more positive lock for the pins so as to assure that they remain in the locking position wherein they retain the coupling 50 in the desired position.

Figure 4:
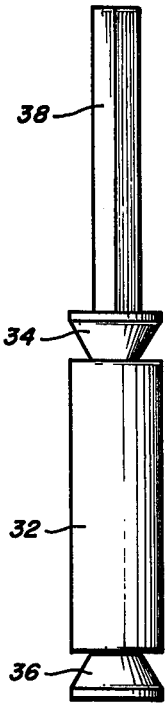
FIG. 4 is a side view of the coupling.
Figure 5:
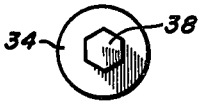
FIG. 5 is an end view of the coupling.

From the foregoing description it will be appreciated that by means of the present invention a coupling is provided which is always available on the tool, which cannot become lost, and which readily and conveniently serves to attach the screwdriver to a power tool. The recess 46 at the handle end 28 which contains the end 60 of the coupling extension 38 protects the hands of the user from the coupling when the screwdriver is driven manually and allows the palm of the hand to be pressed against the handle end as is frequently done to apply an axially directed force to the screwdriver in the direction of the head of the screw being turned. Thus, the recess 46 serves to protect the hands from the coupling. The coupling itself is a very simple structure as shown in FIGS. 4 and 5, and the tool may be made without appreciably greater expense than an ordinary screwdriver.

Having described the invention in detail, those skilled in the art will appreciate that numerous modifications may be made of this invention without departing from its spirit. Therefore, it is not intended to limit the breadth of this invention to the single embodiment illustrated and described. Rather, it is intended that the scope of this invention be determined by the appended claims and their equivalents.

What is claimed is:

1. A screwdriver having a retractable coupling enabling it to be operated manually in the conventional manner or be coupled to a power drill to be operated by it comprising a shank having a tip at one end for engaging the head of a screw a handle permanently fixed to the other end of the shank enabling the screwdriver to be gripped conventionally for conventional manual operation, a chamber in the handle open at the end of the handle away from the shank, a coupling slidable in the chamber between first and second positions, said coupling having a first portion which extends a substantial distance out of the chamber when the coupling is in the first position and being substantially confined within the chamber when the coupling is in the second position, said first portion being shaped so that it may be engaged by a drill chuck, and means for rotatably connecting the handle and coupling together.

2. A screwdriver as defined in claim 1 further characterized by biasing means in the chamber uring the coupling into the first position, and means in the handle for engaging the coupling for releasably retaining the coupling in the second position.

3. A screwdriver as defined in claim 1 further characterized by slot means formed in the coupling, and pin means slidable in the handle and into the slot means for retaining the coupling in the second position.

4. A screwdriver as defined in claim 2 further characterized by second slot means in the coupling, and said pin means being engagable with the second slot means for holding the coupling in the first position.

5. A screwdriver as defined in claim 3 further characterized by spring means in the chamber for biasing the coupling into the first position.

6. A screwdriver as defined in claim 4 further characterized by spring means in the chamber for biasing the coupling into the first position.

7. A screwdriver as defined in claim 1 further characterized by said coupling having a second portion comprising a central section and two opposite end sections, each end section including an annular slot that extends about the full circumference of the coupling, and a pair of pins in the handle and extending into the chamber and adapted to selectively engage one of the annular slots when in alignment with them to hold the coupling in the first or second position, one of said slots being opposite the pins in the first position and the other of the slots being aligned with the pins in the second position.

8. A screwdriver as defined in claim 7 further characterized by an inclined wall defining a portion of each slot, said inclined wall forming cams to move the pins out of the slots when the inclined walls are pushed against the pins in the chamber.

9. A screwdriver as defined in claim 8 further characterized by a spring in the chamber and bearing against the coupling to bias it in one of the two positions.

10. A screwdriver as defined in claim 1 further characterized by a cap forming part of the handle closing the chamber, an opening in the cap through which the first portion extends, said opening and first portion rotatably coupling the handle and coupling together.

11. A screwdriver as defined in claim 2 further characterized by a recess formed in the outer end of the cap, said recess housing the end of the first portion of the coupling when the coupling is in the second position.

12. A screwdriver as defined in claim 3 further characterized by means including an eccentric mounted on the pin means for releasably locking the pin means in a position wherein it engages the slot means.

13. A screwdriver as defined in claim 12 further characterized by said pin means comprising oppositely disposed pins in the handle, and finger grippable ribs on the pins to enable them to be pulled radially in the handle and be rotated therein for moving the eccentric.

14. A screwdriver having a retractable coupling enabling it to be operated manually in the conventional manner or be coupled to a power drill to be operated by it comprising a shank having a tip at one end for engaging the head of a screw, a handle permanently fixed to the other end of the shank enabling the screwdriver to be gripped conventionally for conventional manual operation, a chamber formed in the handle extending coaxially therewith, a coupling slidable in the chamber axially with respect to the handle and having a first portion extending out of the chamber beyond the other end of the handle for being engaged by the chuck of a power drill to be turned with it, said coupling having a second portion confined within the chamber and rigidly connected to the first position, said second portion having a central section and end sections each defining radial slots beyond the ends of the central section, each slot having an inclined wall away from the central section, at least one radially extending pin mounted in the handle and extending into the chamber and adapted to selectively extend into each of the slots of the end portions of the coupling when the pin is moved radially toward the axis of the handle preventing the coupling from moving axially in the chamber, a spring biasing the coupling to a first position toward the other end of the handle wherein the first portion extends out of the chamber for engagement by a drill chuck, and said pin being capable of holding the coupling in a withdrawn position when the coupling is moved against the bias of the spring to a second position wherein the first portion of the coupling is substantially confined to the chamber, and means cooperating with the handle and coupling rotatably connecting them together.

* * * * *